United States Patent [19]

Goodin et al.

[11] 4,248,678

[45] Feb. 3, 1981

[54] ALKYLATING OF NITROGEN ACIDS USING ELECTROGENERATED BASES AS CATALYSTS

[75] Inventors: Richard D. Goodin, St. Louis; Richard C. Hallcher, Maryland Hgts., both of Mo.; Manuel M. Baizer, Santa Monica, Calif.

[73] Assignee: Monsanto Company, St. Louis, Mo.

[21] Appl. No.: 84,940

[22] Filed: Oct. 15, 1979

[51] Int. Cl.[3] ..... C25B 3/00

[52] U.S. Cl. ..... 204/59 R; 204/72

[58] Field of Search ..... 204/59 R, 72

[56] References Cited

U.S. PATENT DOCUMENTS 4,132,611 1/1979 Baizer et al. ..... 204/59 R

OTHER PUBLICATIONS

The Chemistry of Amides, Zabicky, pp. 749–752, Pub. by Interscience, New York (1970).

*Primary Examiner*—F. Edmundson

*Attorney, Agent, or Firm*—L. Bruce Stevens

[57] ABSTRACT

The invention is a process for alkylating nitrogen acids using an electrogenerated base as a catalyst comprising (a) electro-reducing a probase at the cathode by electrolysis in an aprotic liquid electrolysis medium comprising a probase, an anhydrous aprotic solvent, and supporting electrolyte to produce an electrogenerated base, (b) deprotonating a nitrogen acid with the electrogenerated base to produce a nitrogen acid anion, and (c) reacting the nitrogen acid anion with an alkylating agent to produce an alkylated nitrogen acid; with the aforesaid probase being more easily electro-reducible than the nitrogen acid and producing an electrogenerated base strong enough to deprotonate the nitrogen acid which is sufficiently acidic to permit such deprotonation, and the electrogenerated base not reacting readily, unless rapidly reversibly, with the alkylating agent.

15 Claims, No Drawings

ALKYLATING OF NITROGEN ACIDS USING ELECTROGENERATED BASES AS CATALYSTS

BACKGROUND OF THE INVENTION

This invention relates to a process using electrogenerated bases as catalysts for the alkylation of nitrogen acids.

In U.S. Pat. No. 4,132,611, Baizer et al, there is described the use of electrogenerated bases as catalysts for the addition of organic electrophiles to carbon acids, and certain other related prior art is described therein. One of the reactions described in this patent is alkylation of the carbon acid and this is described broadly in column 3, lines 15–27 of the patent.

Nitrogen acids of the type described herein have been previously N-alkylated under basic conditions using a variety of strong bases, e.g., sodium in liquid ammonia or sodium hydride, potassium t-butoxide, etc., in suitable product solvent (J. Zabicky, "The Chemistry of Amides," Interscience Publishers, New York, 1970). The reactions are usually carried out sequentially by adding the base to the nitrogen acid to form the anion and subsequently introducing the alkylating agent.

Although alkali hydroxides have been used to generate nitrogen anions from nitrogen acids under very special conditions, the strong bases having general applicability suffer from the well-recognized disadvantages of cost, safety, ease of handling, waste disposal, or a combinations of these.

The present invention involves the N-alkylation of the described nitrogen acids under anion-forming conditions by the electrochemical generation of strong bases from suitable probases having the advantage that the protonated electrogenerated base may be easily converted to the original probase with the liberation of protons making the alkylation process catalytic in probase and stoichiometric only in electricity. In the preferred embodiment of the invention, the probase is regenerated in situ by anodic oxidation of the protonated electrogenerated base, either directly or indirectly, in an undivided electrochemical cell containing a proton scavenger. Indirect anodic oxidation of the protonated electrogenerated base to probase can be, e.g., with anodically generated halogen.

SUMMARY OF THE INVENTION

The invention is a process for alkylating nitrogen acids using an electrogenerated base as a catalyst comprising (a) electro-reducing a probase at the cathode by electrolysis in an aprotic liquid electrolysis medium comprising a probase, an anhydrous aprotic solvent, and supporting electrolyte to produce an electrogenerated base, (b) deprotonating a nitrogen acid with the electrogenerated base to produce a nitrogen acid anion, and (c) reacting the nitrogen acid anion with an alkylating agent to produce an alkylated nitrogen acid; with the aforesaid probase being more easily electro-reducible than the nitrogen acid and producing an electrogenerated base strong enough to deprotonate the nitrogen acid which is sufficiently acidic to permit such deprotonation, and the electrogenerated base not reacting readily, unless rapidly reversibly, with the alkylating agent.

The nitrogen acids of the invention are of the formula R(R')NH in which R can be H or hydrocarbyl including alkyl, aryl or aralkyl, and R' has an electron-withdrawing group such as carbonyl, sulfonyl or aryl attached directly to the nitrogen, i.e. R' is aryl, hydrocarbyl+carbonyl or sulfonyl, halocarbyl+carbonyl or sulfonyl, or halogen+carbonyl or sulfonyl. For example, R' can be phenyl, $CF_3CO$—, $CCl_3CO$—, $CF_3SO_2$— or $FSO_2$—. The hydrocarbyl groups can be aliphatic, preferably alkyl, or aromatic and can contain substituents such as halogens which do not interfere or take part in the reactions of the process of the invention.

The alkylating agent is characterized by the formula R"W where W is chlorine, bromine, iodine or a halogen equivalent such as p-toluenesulfonate or other moiety recognized for its lability in displacement reactions. R" is aliphatic, preferably alkyl or aralkyl, which can have substituents such as alkoxide, cyano, thioether, carboalkoxy and carboxamino groups which will not interfere with the reactions of the process of the invention.

Typical among the probases which generally satisfy the requirements of the process of the invention, including reoxidation capability, are azobenzenes (including sterically hindered azobenzenes) and ethylenetetracarboxylate tetraesters. Examples of these suitable azobenzenes and tetraester probases are found in U.S. Pat. No. 4,132,611, columns 5 and 6, beginning with column 5, line 37, and the teachings of this patent with regard to examples of these probases are hereby incorporated by reference.

In the solvents employed in the present process, it will generally be desirable to select a solvent (a) which is anhydrous aprotic, (b) which is a weaker acid than the nitrogen acid which is to be alkylated, (c) whose liquid range is such that ease of removal of product on work-up is facilitated but loss by evaporation under process conditions is minimized, (d) which is relatively inert under process conditions, and (e) which has a sufficiently high dielectric constant in order to lower electrical resistance. It will be understood, however, that the choice and concentration of electrolyte can also be used to lower electrical resistance. Solvents desirable for use and practice of the present process preferably have low electrophilicity, that is, suitable solvents are substantially non-electrophilic. Further, it is found in practice that it is generally desirable to employ a solvent with a dielectric constant of at least 25, and preferably at least 50. Examples of such anhydrous aprotic solvents include, for example, acetonitrile, propionitrile, dimethylformamide, N,N-dimethylacetamide, and the like.

Certain salts of alkali metals, amine and quaternary ammonium salts, or mixtures of such can be employed as supporting electrolytes. Among the alkali metal salts useful are lithium, sodium, and potassium salts. Among the quaternary ammonium salts useful are the tetraalkylammonium, for example, tetramethylammonium, tetraethylammonium, tetra-n-propylammonium, and the like, heterocyclic and alkylarylammonium salts, for example, phenyltriethylammonium and the like with the tetralkylammonium salts being generally preferred because of their good solubility and conductivity and because they are difficultly reduced.

Various anions can be used with the foregoing and other cations, for example, halides such as chlorides, bromides, iodides, perchlorates, tetrafluoroborates, hexafluorophosphates, sulfonates, tetraphenylborides and the like.

The concentration of electrolyte salt is not narrowly critical. Thus, for example, suitable concentrations will often be in the range of about 1 percent to about 10 percent by weight of the electrolysis medium or on a molar basis often in the range of about one thousandth to about one molar. The only limitation on the amount of electrolyte salt employed is that the amount is sufficient to promote efficient and economical operation and that it is soluble in the electrolysis medium.

In undivided cells for carrying out the process of the invention, a scavenger is needed which is capable of capturing protons (or water) to produce innocuous scavenger reaction products. Scavengers suitable for the present process are alkali metal carbonates; alkali metal salts of very weak and very insoluble acids, for example, alkali metal tetraborates; basic alumina (which contains alkali metal aluminates, for example, sodium aluminates), acid-type ion exchange resins in the alkali metal form, for example, sulfonic acid-type ion exchange resins in the sodium form and weak-base anion exchange resins in the free base form; epoxides, for example, 1,2-epoxybutane.

In the present process, either an undivided or a divided electrolysis cell can be employed. A divided cell contains a suitable barrier material or separator which will prevent the free flow of reactants between the cathode and anode. Normally, in the process of the present invention, an undivided cell is preferred. It will be appreciated that the electrolysis cells employed in the examples are primary for laboratory demonstration purposes and production cells are usually designed with a view to the economics of the process. For a general description of various laboratory scale cells, see Lund et al, "Practical Problems in Electrolysis," in Organic Electrochemistry (Baizer, ed) Marcel Dekker, New York, 1973, pp. 165–249, and for some consideration of industrial cell designs, see Danly, "Industrial Electroorganic Chemistry," in ibid, pp. 907–946. The present process is suited to batch, semi-continuous, or continuous operations.

For convenience, temperatures in the range of about 0° to about 100° C. can be used with temperatures between 20° C. and about 55° C. being preferred. The process can be conducted at atmospheric pressure, superatmospheric pressures, and subatmospheric pressures. However, for reasons of economy and ease of construction of equipment employed in the present process, it is preferred to conduct this process at approximately atmospheric pressure.

The following examples indicate the present invention and the manner by which it can be practiced.

EXAMPLE 1

A three-compartment cell having a cathode compartment, an anode compartment, and a buffer compartment located between the cathode and anode compartments was employed. The cathode and anode compartments were each separated from the buffer compartment by a medium porosity glass frit. The cathode was a 2.5 centimeter×5.0 centimeter 45 mesh platinum gauze strip and the anode was a 0.635 centimeter (0.25 inch) outside diameter carbon rod. The cathode compartment contained a gas inlet and outlet for passing gas through the catholyte as desired. A silver wire electrode inserted into a glass tube capped by a 1.0 centimeter medium porosity frit at the end to be immersed in catholyte was placed near the cathode surface to serve as a pseudo reference electrode. Stirring in the cathode compartment was accomplished by a magnetic stirrer.

The entire procedure was carried out in a dry nitrogen flushed dry box.

To the cathode compartment was charged 70 milliliters of 0.1 molar solution of tetramethylammonium perchlorate in dry acetonitrile, 0.55 grams (2.72 millimoles) of N-(2,6-dimethyl-1-cyclohexen-1-yl)-2-chloroacetamide of the formula

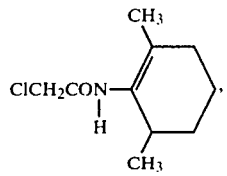

0.20 grams (0.68 millimoles) of 2,2'-di-t-butylazobenzene and 0.16 grams (0.17 ml) (1.7 millimoles) of chloromethyl ethyl ether of the formula $ClCH_2OC_2H_5$. Each of the anode and buffer compartments were charged with 30 milliliters and 20 milliliters respectively of the 0.1 molar solution of tetrabutylammonium perchlorate in dry acetonitrile. The catholyte was deoxygenated by passing dry argon therethrough.

The electrolysis was carried out at ambient temperatures (without temperature controls) at a cathode potential of −1.8 volts (versus the silver wire pseudo reference electrode) and a current of 80 milliamperes until a total of 130.5 coulombs (2.0 Faradays per mole of azo compound) had passed.

Upon completion of the electrolysis, acetonitrile was removed under reduced pressure. The residue was triturated with dry ethyl ether to extract the product and starting material. Gas chromatography shows approximately 40% conversion to the alkylated product which is N-(2,6-dimethyl-1-cyclohexen-1-yl)-N-(ethoxymethyl)-2-chloroacetamide of the formula

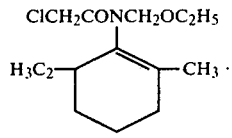

Analysis by nmr (nuclear magnetic resonance) gives 41% product. Current efficiency was 82%.

EXAMPLE 2

In this example an undivided, cylindrical cell was used in which two platinum-gauze electrodes were mounted vertically and parallel, demonstrating the preferred embodiment, i.e. in situ regeneration of probase in the presence of a proton scavenger ($Cl^-$/epoxide system). Stirring was by magnetic stirrer as in Example 1. The reaction medium was 50 ml of acetonitrile and the electrolyte added thereto was 1.9 grams of tetrabutylammonium chloride. To the reaction medium to serve as a catalyst, was charged 0.10 grams (0.34 millimoles) of 2,2'-di-t-butylazobenzene, and 0.10 grams (0.34 millimoles) of 2,2'-di-t-butylhydrazobenzene was also charged to the reaction medium since some hydrazo with the azo is needed to get the catalytic reaction started in an undivided cell, the hydrazo being oxidized to azo at the anode. Also charged to the reaction medium is 0.72 grams (3.4 millimoles) of 2'-ethyl-6'-methyl-2-chloroacetanilide of the formula

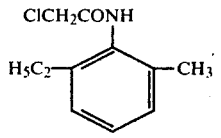

and 0.35 grams (0.37 ml) (3.74 millimoles) of chloromethyl ethyl ether, the alkylating agent. The proton scavenger charged to the reaction medium was 0.49 grams (0.58 ml) (6.0 millimoles) of 1,2-epoxybutane.

The reference electrode was silver and the potential was controlled at the anode. At the beginning of the electrolysis, the voltage was +1.2 volts and the current 70 milliamperes, but after 55 coulombs of electricity had been consumed, the voltage and current leveled off at +1.25 volts and 80 milliamperes. The electrolysis was terminated after 328 coulombs (1 Faraday per mole of amide) of electricity had been consumed. Acetonitrile was removed under reduced pressure, the residue was treated with water, and the aqueous solution was extracted with ethyl ether. Gas chromatographic analysis indicated 61% alkylated amide product yield (61% current efficiency). Nuclear magnetic resonance analysis indicated 58% yield of alkylated amide product. The product was 2'-ethyl-6'-methyl-N-(ethoxymethyl)-2-chloroacetanilide of the formula

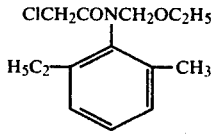

EXAMPLE 3

In this experiment, the divided cell of Example 1 was used. The reaction medium was 125 ml of acetonitrile and the electrolyte 3.75 grams of tetraethylammonium tosylate. The other ingredients used in the experiment were 0.25 grams (0.85 millimoles) of 2,2'-di-t-butylazobenzene, the nitrogen acid charged was 0.34 grams (1.7 millimoles) of 2',6'-dimethyl-2-chloroacetanilide of the formula

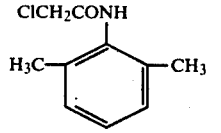

and the alkylating agent was 0.35 grams (0.29 ml) (1.87 millimoles) of methyl tosylate of the formula

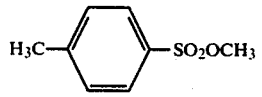

Electrolysis conditions were −1.5 volts measured against the silver pseudo reference electrode and 80 milliamperes of current. After 140 coulombs of electricity had been used, the current began to drop and at 165 coulombs (2 Faradays/mole of azo), the current had dropped to 1 to 2 milliamperes.

Aqueous work-up of the reaction mixture was carried out as follows: Acetonitrile was removed under reduced pressure. The residue was treated with water and the aqueous mixture was extracted with ethyl ether. The organic layer was dried with magnesium sulfate, filtered and the ethyl ether removed under reduced pressure. Yield was 0.6 grams of residue. Both the gas chromatography and nuclear magnetic resonance analysis indicated almost pure alkylated product which was 2-chloro-N-methyl-2',6'-dimethylacetanilide of the formula

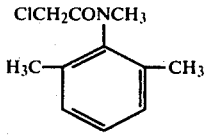

and 2,2'-di-t-butylhydrazobenzene formed by protonation of the electrogenerated base.

EXAMPLE 4

The divided cell used in Example 1 was used in this example. The reaction medium was 125 ml of acetonitrile and 3.75 grams of tetraethylammonium tosylate electrolyte. Also charged in the example was 0.37 grams (0.85 millimoles) of 2,2',4,4',6,6'-hexaisopropylazobenzene. Also charged was 0.26 grams (1.7 millimoles) of the nitrogen acid which was 2-chloro-N-(1,2-dimethylpropyl)acetamide of the formula

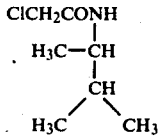

and 0.214 grams (0.16 ml) (1.7 millimoles) of the alkylating agent which was methylsulfate of the formula $(CH_3)_2SO_4$. Beginning the electrolysis −2.0 volts and a current of 70 milliamperes was used but by the time 100 coulombs of electricity had been consumed, the current had risen to 135 milliamperes. The electrolysis was terminated after 179 coulombs (2.2 Faradays/mol azo) of electricity had been used and the current had dropped to 15 milliamperes. Aqueous work-up of the product was conducted as in Example 3. The product was 2-chloro-N-(1,2-dimethylpropyl)-N-methylacetamide of the formula

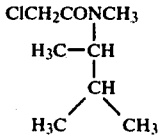

The product was formed in quantitative yield.

EXAMPLE 5

The electrolytic cell used in this experiment is an undivided, cylindrical cell in which a pool of mercury serves as the cathode and a platinum-gauze anode was mounted horizontally above the cathode. A silver cathode was used as the reference electrode associated with the platinum anode. Stirring was by magnetic stirring bar located on the mercury cathode surface.

The reaction medium was 50 ml of acetonitrile containing 1.4 grams of tetrabutylammonium chloride electrolyte. The probase was 0.10 grams (0.34 millimoles) of 2,2'-di-t-butylazobenzene and also charged to the reaction vessel was 2,2'-di-t-butylhydrazobenzene in an amount of 0.10 grams (0.34 millimoles). The nitrogen acid was 2',6'-dimethyl-2-chloroacetanilide in an amount of 0.67 grams (3.4 millimoles) and the alkylating agent charged to the reaction medium was 0.35 grams (0.37 ml) 3.74 millimoles) of chloromethyl ethyl ether. Also charged to the reaction vessel was 0.54 grams (0.65 ml) (7.5 millimoles) of 1,2-epoxybutane as a scavenger.

The electrolysis was carried out at +1.0 volts and 50 milliamps current. The electrolysis was continued until 328 coulombs (1 Faraday per mole of amide) of electricity had been used. Measurement before work-up of product indicated 84% alkylation and 84% current efficiency. A final work-up of the reaction mixture and nuclear magnetic resonance measurement indicated 70% alkylation. The product was 2',6'-dimethyl-N-(ethoxymethyl)-2-chloroacetanilide.

EXAMPLE 6

The electrolytic cell was the same cell used in Example 5. A different proton scavenger was used rather than the epoxide which was an ion exchange resin diisopropylaminomethyl polystyrene. To the reaction vessel was charged 50 ml of acetonitrile reaction medium, 1.4 grams of tetrabutylammonium chloride electrolyte, 0.10 grams (0.34 millimoles) of 2,2'-di-t-butylazobenzene, 0.10 grams (0.34 millimoles) of 2,2'-di-t-butylhydrazobenzene, 0.67 grams (3.4 millimoles) of the nitrogen acid, 2',6'-dimethyl-2-chloroacetanilide, 0.35 grams (0.37 ml) (3.74 millimoles) of chloromethyl ethyl ether alkylating agent, and 2.0 grams of the diisopropylaminomethyl polystyrene proton scavenger.

Electrolysis conditions were +1.1 volt and 30 milliamps of current with termination of the reaction after 328 coulombs of electricity were used up. Fifty-five percent alkylation was obtained with 55% current efficiency. The product was the same as in Example 5, namely, 2'6'-dimethyl-N-(ethoxymethyl)-2-chloroacetanilide.

EXAMPLE 7

In this experiment the same electrolysis cell was used as was used in Examples 5 and 6. To the cell was charged 50 ml of acetonitrile reaction medium, 1.5 grams of tetraethylammonium tosylate electrolyte, 0.10 grams (0.34 millimoles) of 2,2-di-t-butylazobenzene, 0.12 grams (0.34 millimoles) of 2,2'-di-t-butylhydrazobenzene, 0.67 grams (3.4 millimoles) of the nitrogen acid 2',6'-dimethyl-2-chloroacetanilide, 0.47 grams (0.35 ml) (3.74 millimoles) of methylsulfate, and 2.0 grams of the diisopropylaminomethyl polystyrene proton scavenger.

Electrolysis conditions were 1.0 volts and 40 to 50 milliamps current. The electrolysis was terminated after 328 coulombs of the electricity had been used and the current at this time was 25 milliamps. Percent alkylation was 24% and current efficiency was 24%. The product was 2-chloro-N-methyl-2',6'-dimethylacetanilide.

Products of the process of the invention are well known for their herbicidal activity.

Although the invention has been described in terms of specified embodiments which are set forth in considerable detail, it should be understood that this is by way of illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. A process for alkylating nitrogen acid, acetamides and acetanilides using an alkylating agent and an electrogenerated base comprising (a) electro-reducing a probase at the cathode by electrolysis in an aprotic liquid electrolysis medium comprising a sterically hindered azobenzene probase, an anhydrous aprotic solvent, and supporting electrolyte to produce an electrogenerated base;

(b) deprotonating a nitrogen acid acetamide or acetanilide, with the electrogenerated base to produce a nitrogen acid, acetamide or acetanilide anion;

(c) reacting the nitrogen acid anion with an alkylating agent of the formula R"W where R" is aliphatic and W is a chlorine, bromine, iodine or halogen equivalent leaving group to produce an alkylated nitrogen acid acetamide or acetanilide; with the aforesaid probase being more easily electro-reducible than the nitrogen acid and producing an electrogenerated base strong enough to deprotonate the nitrogen acid which is sufficiently acidic to permit such deprotonation, and the electrogenerated base not reacting readily, unless rapidly reversibly, with the alkylating agent.

2. A process of claim 1 wherein the reaction is catalytic with the electrogenerated base after deprotonation of the nitrogen acid being converted by anodic oxidation to probase.

3. A process of claim 1 wherein said probase is 2,2'-di-t-butylazobenzene.

4. A process of claim 1 wherein said probase is 2,2',4,4',6,6'-hexaisopropylazobenzene.

5. A process of claim 1 wherein said anhydrous aprotic solvent is acetonitrile.

6. A process of claim 1 wherein a proton scavenger is used.

7. A process of claim 6 wherein said proton scavenger is 1,2-epoxybutane.

8. A process of claim 6 wherein said proton scavenger is diisopropylaminomethyl polystyrene resin.

9. A process of claim 1 wherein a divided electrolysis cell is used, said nitrogen acid is N-(2,6-dimethyl-1-cyclohexen-1-yl)-2-chloroacetamide, said alkylating agent is chloromethyl ethyl ether, said probase is 2,2'-di-t-butylazobenzene, and said alkylated nitrogen acid is N-(2,6-dimethyl-1-cyclohexen-1-yl)-N-(ethoxymethyl)-2-chloroacetamide.

10. A process of claim 1 wherein an undivided electrolysis cell is used together with a 1,2-epoxybutane proton scavenger, said nitrogen acid is 2'-ethyl-6'-methyl-2-chloroacetanilide, said alkylating agent is chloromethyl ethyl ether, said probase is 2,2'-di-t-butylazobenzene, and said alkylated nitrogen acid is 2'-ethyl-6'-methyl-N-(ethoxymethyl)-2-chloroacetanilide.

11. A process of claim 1 wherein a divided electrolysis cell is used, said nitrogen acid is 2',6'-dimethyl-2-chloroacetanilide, said alkylating agent is methyl tosylate, said probase is 2,2'-di-t-butylazobenzene, and said alkylated nitrogen acid is 2-chloro-N-methyl-2',6'-dimethylacetanilide.

12. A process of claim 1 wherein a divided electrolysis cell is used, said nitrogen acid is 2-chloro-N-(1,2-dimethylpropyl)acetamide, said alkylating agent is methylsulfate, said probase is 2,2',4,4',6,6'-hexaisopropylazobenzene, and said alkylated nitrogen acid is 2-chloro-N-(1,2-dimethylpropyl)-N-methylacetamide.

13. A process of claim 1 wherein an undivided electrolysis cell is used together with 1,2-epoxybutane proton scavenger, said nitrogen acid is 2',6'-dimethyl-2-chloroacetanilide, said alkylating agent is chloromethyl ethyl ether, said probase is 2,2'-di-t-butylazobenzene, and said alkylated nitrogen acid is 2',6'-dimethyl-N-(ethoxymethyl)-2-chloroacetanilide.

14. A process of claim 1 wherein an undivided electrolysis cell is used together with diisopropyl aminomethyl polystyrene proton scavenger, said nitrogen acid is 2',6'-dimethyl-2-chloroacetaniline, said alkylating agent is chloromethyl ethyl ether, said probase is 2,2'-di-t-butylazobenzene, and said alkylated nitrogen acid is 2',6'-dimethyl-N-(ethoxymethyl)-2-chloroacetanilide.

15. A process of claim 1 wherein an undivided electrolysis cell is used together with diisopropyl aminomethyl polystyrene proton scavenger, said nitrogen acid is 2',6'-dimethyl-2-chloroacetanilide, said alkylating agent is methylsulfate, said probase is 2'-di-t-butylazobenzene, and said alkylated nitrogen acid is 2-chloro-N-methyl-2',6'-dimethylacetanilide.

* * * * *